US010050379B2

(12) United States Patent
Urai et al.

(10) Patent No.: US 10,050,379 B2
(45) Date of Patent: Aug. 14, 2018

(54) CONNECTOR

(71) Applicants: FUJIKURA LTD., Tokyo (JP); DDK LTD., Tokyo (JP)

(72) Inventors: Harunori Urai, Tokyo (JP); Masayuki Suzuki, Tokyo (JP); Hirokazu Takahashi, Tokyo (JP); Yuuki Nakano, Tokyo (JP)

(73) Assignees: FUJIKURA LTD., Tokyo (JP); DDK LTD., Tokyo (JP)

( * ) Notice: Subject to any disclaimer, the term of this patent is extended or adjusted under 35 U.S.C. 154(b) by 42 days.

(21) Appl. No.: 15/429,464

(22) Filed: Feb. 10, 2017

(65) Prior Publication Data

US 2017/0229809 A1 Aug. 10, 2017

(30) Foreign Application Priority Data

Feb. 10, 2016 (JP) ..... 2016-024127

(51) Int. Cl.

| | |
|---|---|
| ***H01R 13/62*** | (2006.01) |
| ***H01R 13/627*** | (2006.01) |
| ***H01R 12/72*** | (2011.01) |
| ***H01R 13/631*** | (2006.01) |
| ***H01R 12/88*** | (2011.01) |
| *H01R 13/41* | (2006.01) |

(52) U.S. Cl.

CPC ..... *H01R 13/6271* (2013.01); *H01R 12/721* (2013.01); *H01R 12/88* (2013.01); *H01R 13/631* (2013.01); *H01R 13/41* (2013.01)

(58) Field of Classification Search

CPC ..... H01R 13/15; H01R 4/24; H01R 13/6271

USPC ..... 439/328, 260

See application file for complete search history.

(56) References Cited

U.S. PATENT DOCUMENTS

| | | | | |
|---|---|---|---|---|
| 7,766,680 | B2 * | 8/2010 | Suzuki | H01R 12/88 439/260 |
| 7,833,046 | B2 * | 11/2010 | Tamura | H01R 12/774 439/329 |
| 2007/0298628 | A1 * | 12/2007 | Suzuki | H01R 12/79 439/77 |
| 2009/0017645 | A1 * | 1/2009 | Suzuki | H01R 12/79 439/62 |

(Continued)

FOREIGN PATENT DOCUMENTS

| | | |
|---|---|---|
| JP | 2010-212265 | 9/2010 |

*Primary Examiner* — Abdullah Riyami
*Assistant Examiner* — Nader Alhawamdeh
(74) *Attorney, Agent, or Firm* — Procopio, Cory, Hargreaves & Savitch LLP

(57) ABSTRACT

The present invention provides a connector includes a housing having a fitting opening for the object to be connected, signal contacts retained in the housing in parallel disposition, a pressure member capable of pressing the signal contacts, and power source contacts. The power source contacts are retained besides the signal contacts, have a thickness dimension larger than that of the signal contacts and are to be pressed by the pressure member together with the signal contacts. The power source contacts include a power source contact with a fixation function, having not only the power source connection function but also a function of temporally fixing the object to be connected at a correct insertion position with respect to the signal contacts as well as a function of clamping and fixing the object to be connected in a state of being pressed by the pressure member.

16 Claims, 8 Drawing Sheets

(56) References Cited

U.S. PATENT DOCUMENTS

| | | | | |
|---|---|---|---|---|
| 2009/0047836 | A1* | 2/2009 | Suzuki | H01R 12/73<br>439/638 |
| 2009/0068860 | A1* | 3/2009 | Suzuki | H01R 12/79<br>439/67 |
| 2009/0130881 | A1* | 5/2009 | Suzuki | H01R 12/88<br>439/260 |
| 2016/0198572 | A1* | 7/2016 | Ishida | H01R 12/88<br>439/629 |
| 2016/0204532 | A1* | 7/2016 | Ishida | H05K 1/117<br>439/61 |

* cited by examiner

CONNECTOR

BACKGROUND OF THE INVENTION

CROSS REFERENCE TO RELATED APPLICATION

This application is based upon and claims the benefit of priority from Japanese patent application No. 2016-024127, filed on Feb. 10, 2016, the disclosure of which is incorporated herein in its entirety by reference.

FIELD OF THE INVENTION

The present invention relates to a connector used in an electronic device such as a mobile phone, a laptop, a digital camera etc., in particular, a structure of a connector connected to an object to be connected such as a flexible printed board or a flexible flat cable so as to be capable of allowing a large current to flow.

BACKGROUND ART

A connector detachably fitted to an object to be connected is described in JP-A-2010-212265. The connector comprising a housing, a plurality of terminals (contacts) alternately retained in parallel in the housing, a metal fitting provided close to the contacts located at both ends of the parallel direction of the contacts, and a pressurization member (pressure member) rotatably supported by the housing.

In JP-A-2010-212265, a structure of a connector is disclosed in which a contact other than the signal contact for receiving the current signal of a plurality of contacts is used as a power source contact for applying a power source current when a current is to be applied. Furthermore, if it is necessary to apply a relative large current to the connector, it is general to select a structure in which the number of the power source contact increases depending on the current value to be applied and the contacts are connected in parallel.

SUMMARY OF THE INVENTION

However, in a structure in which the number of the contacts connected in parallel for the power source simply increases in case of applying a large current to a connector, the dimension of the entire connector is enlarged in the direction of the alignment of the connector, causing an increase of the area occupied by the connector at the circuit board. Thus, there is room for improvement in the aspect of space saving of the connector.

Furthermore, in a structure in which the number of the provided terminals having a structure equal to that of a signal contact simply increases depending on a value of the applied current to convert into a power source contact, the value of the current capable of being applied cannot be effectively enhanced. Thus, there is room for improvement.

Thus, an object of the present invention is, with an intention of the optimization of the contact installed in the connector, to provide a connector which downsizing is achieved by providing a power source contact which has a power source connection function by which a large current is applied while suppressing the resistance value of the entire connector, as well as a fixation function by which an object to be connected is capable of being provisionally fixed in the housing.

The present invention addresses the problems discussed above, and the essential point of the invention is as follows.

(1) According to the invention, there is provide a connector detachably fitted to an object to be connected including a housing having a fitting opening for insertion and extraction of the object to be connected, a desired number of signal contacts (SC) being retained in the housing in parallel with each other, and a pressure member having a portion with a shape capable of pressing the signal contact (SC). The connector further includes at least one pair of power source contacts (PC), which is retained in the housing at both end sides of the desired number of the signal contacts (SC) along the signal contacts (SC), has a thickness dimension larger than that of the signal contact (SC), is configured to be pressed by the pressure member together with the signal contact (SC), and has a power source connection function. The at least one pair of the power source contacts (PC) comprises a power source contact (LPC) with a fixation function which has not only the power source connection function but also a function by which the object to be connected is temporally (provisionally) fixed at a correct insertion position with respect to the signal contact (SC) as well as the object to be connected is clamped and fixed in a state being pressed by the pressure member.

(2) In the connector of the above (1), it is preferable that the at least one pair of the power source contacts (PC) further comprise at least one pair of simple power source contacts (NPC) located between the one pair of the power source contacts (LPC) with the fixation function and the desired number of the signal contacts (SC), or respectively outside the power source contact (LPC) with the fixation function.

(3) In the connector of the above (1) or (2), it is preferable that the power source contact (LPC) with the fixation function comprises a contact portion (LPC1) which comes into contact with one of the both surfaces of the object to be connected, an engagement portion (LPC2) which has a shape protruding toward a portion to be engaged at a position corresponding to the portion to be engaged formed at the inserted object to be connected a coupling portion (LPC5) which couples the contact portion (LPC1) and the engagement portion (LPC2) a pressure receiving portion (LPC3) which extends from one end side of the coupling portion (LPC5) to a side opposite to the fitting opening and is pressed by the pressure member, and a connection portion (LPC4) which extends from the other end side of the coupling portion (LPC5) to a side opposite to the fitting opening and is to be connected to a substrate.

(4) In the connector of the above (3), it is preferable that a portion of the power source contact (LPC) with the fixation function located between the connection portion (LPC4) and the coupling portion (LPC5) has a width dimension equal to or larger than the thickness dimension.

(5) In the connector of the above (1) or (2), it is preferable that the power source contact (LPC) with the fixation function comprises a contact portion (LPC1) which comes into contact with one of the both surfaces of the object to be connected, an engagement portion (LPC2) which has a shape protruding toward a portion to be engaged at a position corresponding to the portion to be engaged formed at the inserted object to be connected, a coupling portion (LPC5) which couples the contact portion (LPC1) and the engagement portion (LPC2), a pressure receiving portion (LPC3) which extends from one end side of the coupling portion (LPC5) to a side opposite to the fitting opening and is pressed by the pressure member, and a connection portion (LPC4) which extends from the other end side of the coupling portion (LPC5) toward a side of the fitting opening and is to be connected to a substrate.

(6) In the connector of the above (4) or (5), it is preferable that the power source contact (LPC) with the fixation function further comprises a facing contact portion (LPC6) to be in contact with a surface opposed to a surface of the object to be connected, with which the contact portion (LPC1) comes into contact, between the engagement portion (LPC2) and the coupling portion (LPC5).

(7) In the connector of the above (3) to (6), it is preferable that the pressure member rotates in a range of rotation from a pressure release completion position at which the object to be connected is capable of being inserted into and extracted from the housing, without pressing the signal contact (SC) and the power source contact (PC), to a pressure completion position at which the signal contact (SC) and the power source contact (PC) are pressed and a pressure contact state of the signal contact (SC) and the power source contact (PC) with respect to the object to be connected located at the correct insertion position is stably kept so that the object to be connected is fixed at the correct insertion position.

(8) In the connector of the above (7), it is preferable that at least a portion of the pressure receiving portion (LPC3) of the power source contact (LPC) with the fixation function which the pressure member presses and comes into contact with is flat.

(9) In the connector of the above (7) or (8), it is preferable that the power source contact (LPC) with the fixation function further comprises a swelling prevention means at a tip end portion of the pressure receiving portion (LPC3) which prevents the pressure member from swelling and moving into a direction opposite to the fitting opening of the housing resulting from repulsion to a pressure of the pressure member.

(10) In the connector of the above (2), it is preferable that the simple power source contact (NPC) comprises a contact portion (NPC1) which comes into contact with one of the both surfaces of the object to be connected located at the correct insertion position, a pressure receiving portion (NPC2) which is pressed by the pressure member, a connection portion (NPC3) which is to be connected to a substrate, and a coupling portion (NPC4) which couples the contact portion (NPC1), the pressure receiving portion (NPC2) and the connection portion (NPC3), wherein the contact portion (NPC1) and the pressure receiving portion (NPC2) extend from one end side of the coupling portion (NPC4) to mutually opposite sides, and the connection portion (NPC3) extends from the other end side of the coupling portion (NPC4) to a side opposite to the fitting opening.

(11) In the connector of the above (10), it is preferable that a portion of the simple power source contact (NPC) located between the connection portion (NPC3) and the coupling portion (NPC4) has a width dimension equal to or larger than the thickness dimension.

(12) In the connector of the above (2), it is preferable that the simple power source contact (NPC) comprises a contact portion (NPC1) which comes into contact with the object to be connected located at the correct insertion position, a pressure receiving portion (NPC2) which is pressed by the pressure member, a connection portion (NPC3) which is to be connected to a substrate, and a coupling portion (NPC4) which couples the contact portion (NPC1), the pressure receiving portion (NPC2) and the connection portion (NPC3), wherein the contact portion (NPC1) and the pressure receiving portion (NPC2) extend from one end side of the coupling portion (NPC4) to mutually opposite sides, and the connection portion (NPC3) extends from the other end side of the coupling portion (NPC4) to a side of the fitting opening.

(13) In the connector of the above (10), (11) or (12), it is preferable that the simple power source contact (NPC) comprises a facing contact portion (NPC5) to come into contact with a surface opposed to a surface of the object to be connected, with which the contact portion (NPC1) comes into contact.

(14) In the connector of the above (10) to (13), it is preferable that a portion of the pressure receiving portion (NPC2) of the simple power source contact (NPC) which the pressure member at least presses and comes into contact with is formed flat.

(15) In the connector of one of the above (10) to (14), it is preferable that the simple power source contact (NPC) comprises a swelling prevention means at a tip end portion of the pressure receiving portion (NPC2) which prevents the pressure member from swelling and moving into a direction opposite to the fitting opening of the housing resulting from repulsion to a pressure of the pressure member.

(16) In the connector of one of the above (1) to (15), it is preferable that the housing comprises a plurality of grooves formed at an inner surface facing the direction of height of the housing to individually retain all of the contacts.

Effect of the Invention

According to the present invention, it is provided a connector detachably fitted to an object to be connected, comprising, a housing having a fitting opening for insertion and extraction of the object to be connected, a desired number of signal contacts (SC) being retained in the housing in parallel with each other, a pressure member having a portion with a shape capable of being pressed to the signal contact (SC), and at least one pair of power source contacts (PC) which is retained at both end sides of the desired number of the signal contacts (SC) along the signal contacts (SC), has a thickness dimension larger than that of the signal contact (SC), is configured to be pressed by the pressure member together with the signal contact (SC), and has a power source connection function, wherein the at least one pair of the power source contacts (PC) comprises a power source contact (LPC) with a fixation function which has not only the power source connection function but also a function by which the object to be connected is temporally fixed at a correct insertion position with respect to the signal contact (SC) as well as the object to be connected is clamped and fixed in a state being pressed by the pressure member. Thereby, a connector can be provided by which a space saving is achieved without an increase of the number of the contacts in the connector, allowing a large current to flow while suppressing the resistance value of the entire connector, as well as allowing the object to be connected to be provisionally fixed.

DETAILED DESCRIPTION OF THE SPECIFIC EMBODIMENTS

Hereafter, embodiments of the invention will be described with reference to the drawings. The invention is not limited to the embodiments described below, and various modification may be made without departing from the scope of the present invention.

Figure 1:
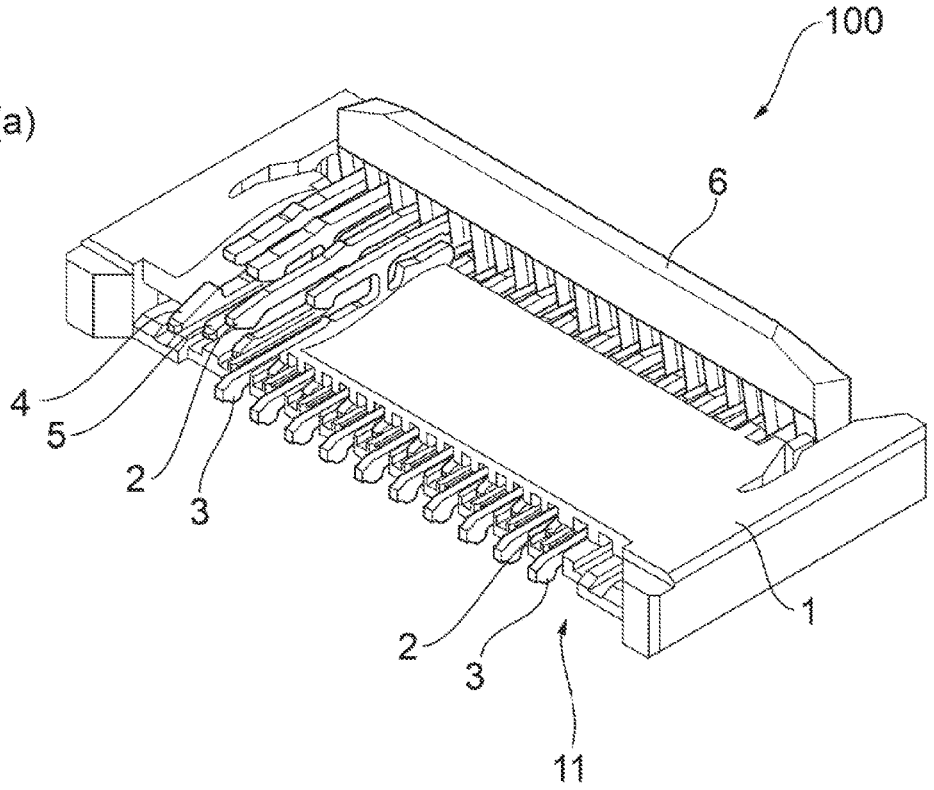
FIGS. 1(*a*) and 1(*b*) are perspective views of the connector of the present invention, wherein FIG. 1(*a*) is a perspective view of the connector illustrated such that an interior portion of the connector is visible by omitting an illustration of a part of the housing, and FIG. 1(*b*) is a perspective view of a state in which the object to be connected is inserted in the connector illustrated in FIG. 1(*a*).
Figure 1:
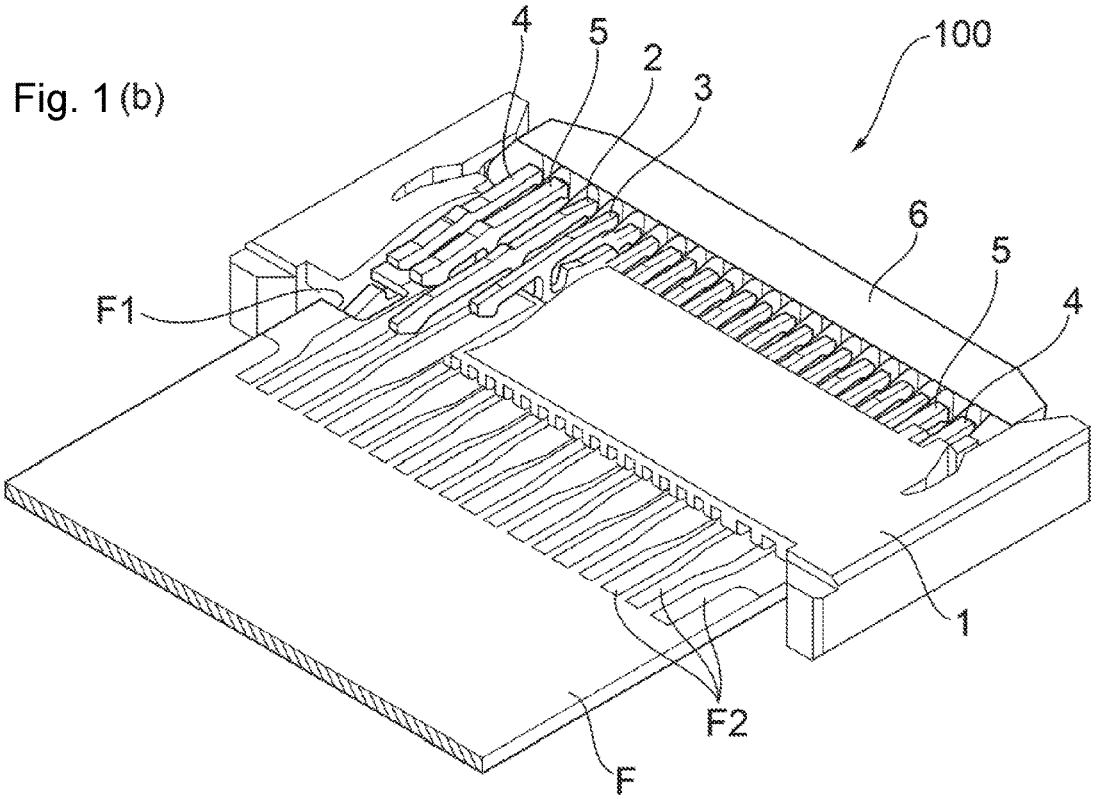
Figure 2:
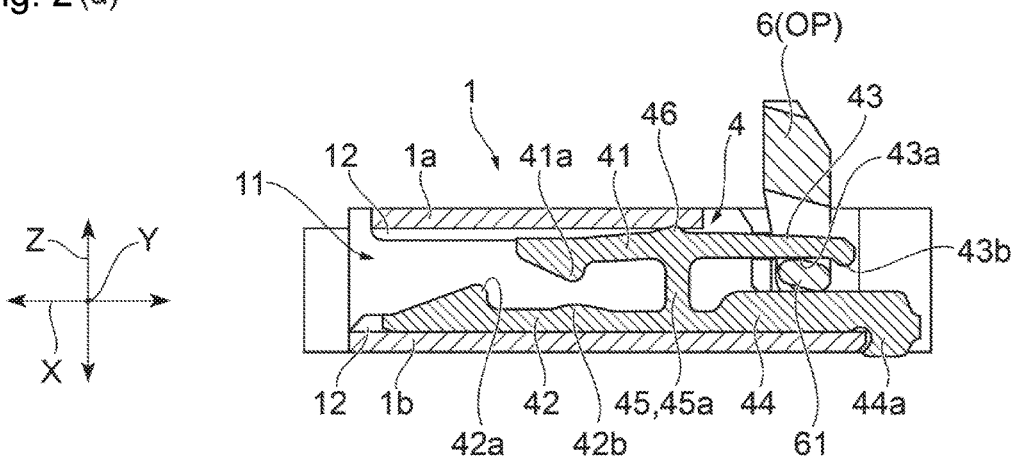
FIGS. 2(*a*) and 2(*b*) are a sectional views of the power source contact with a fixation function retained in the housing, wherein FIG. 2(*a*) is a sectional view of the power source contact with a fixation function in a case in which the pressure member is located at the pressure release completion position, and FIG. 2(*b*) is a sectional view of the power source contact with a fixation function in a case in which the pressure member is located at the pressure completion position.
Figure 2:
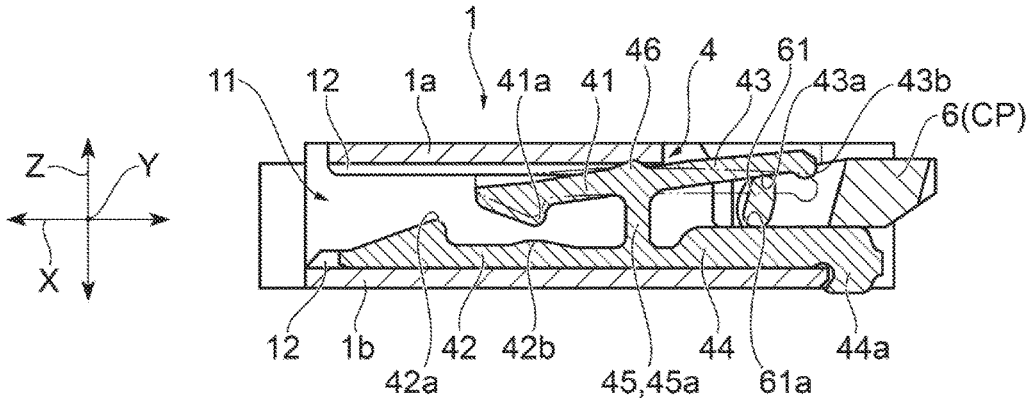
Figure 3:
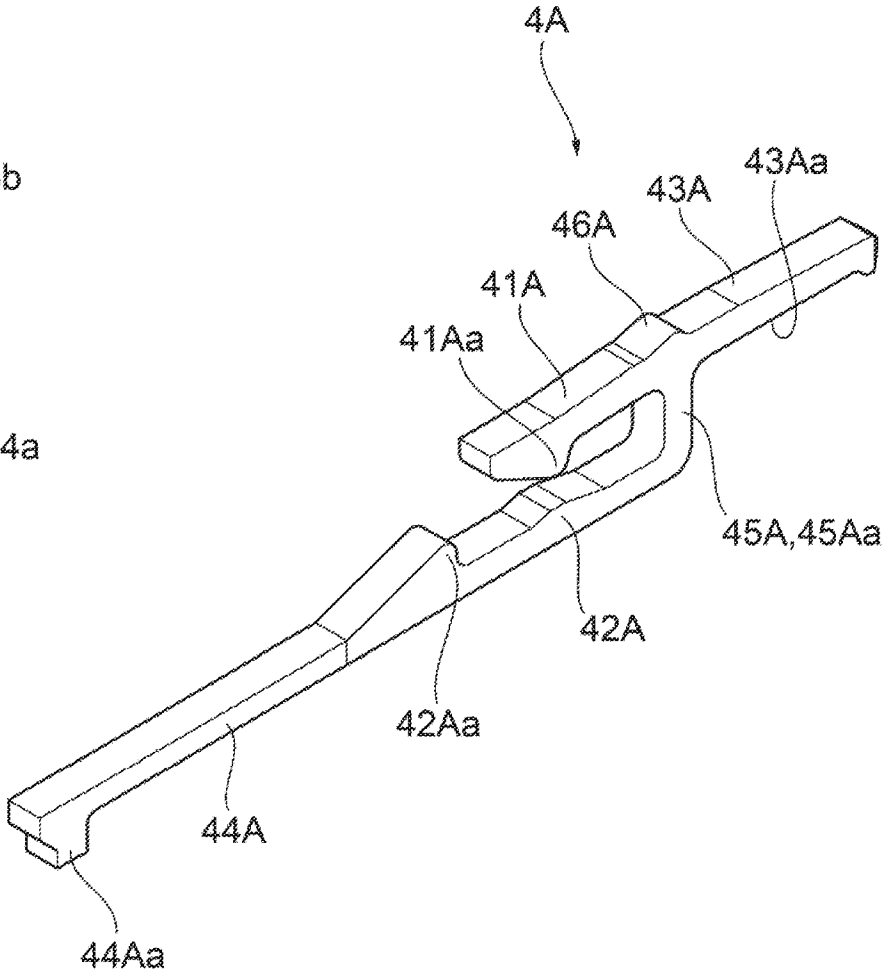
FIGS. 3(*a*) and 3(*b*) are a perspective views of the power source contact with a fixation function, wherein FIG. 3(*a*) is a perspective view of the power source contact with a fixation function of the first embodiment, and FIG. 3(*b*) is a perspective view of the power source contact with a fixation function of the second embodiment.
Figure 3:
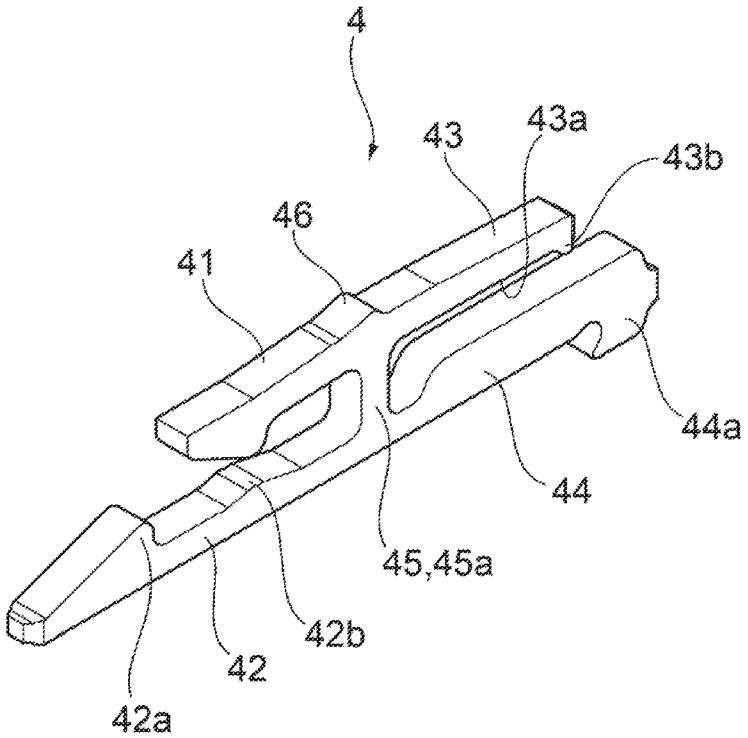
Figure 4:
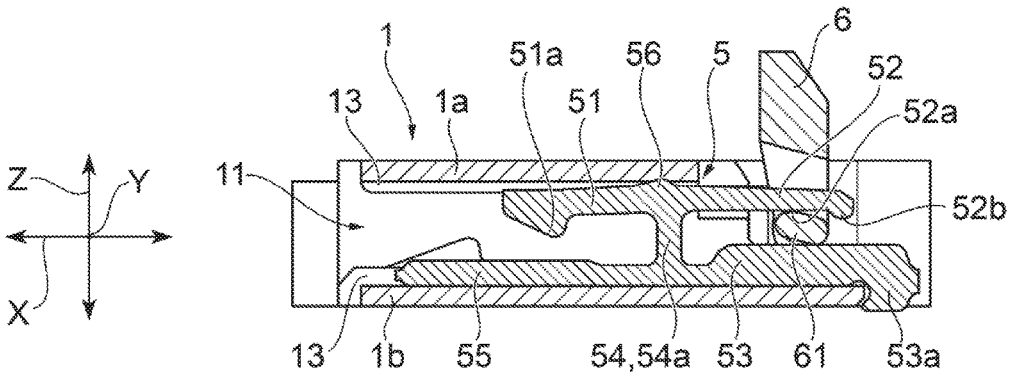
FIGS. 4(*a*) and 4(*b*) illustrate the simple power source contact, wherein FIG. 4(*a*) is a sectional view of the simple power source contact retained in the housing, and FIG. 4(*b*) is a perspective view of the simple power source contact.
Figure 4:
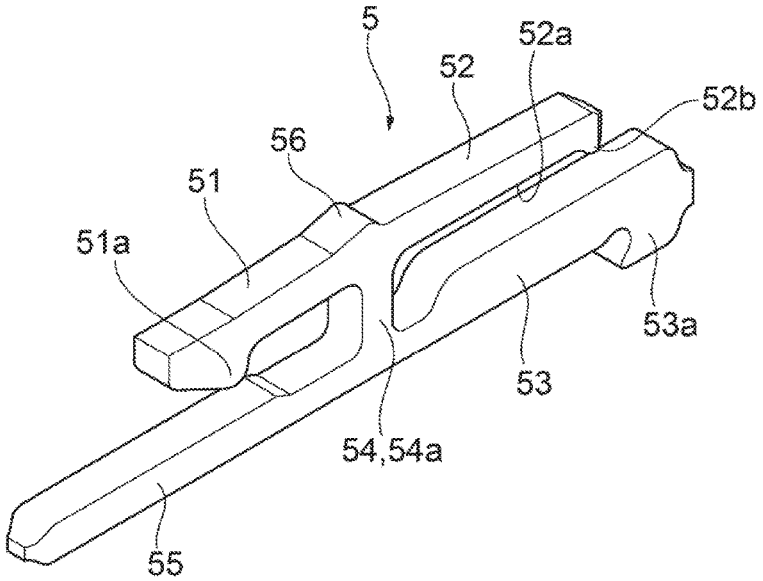
Figure 5:
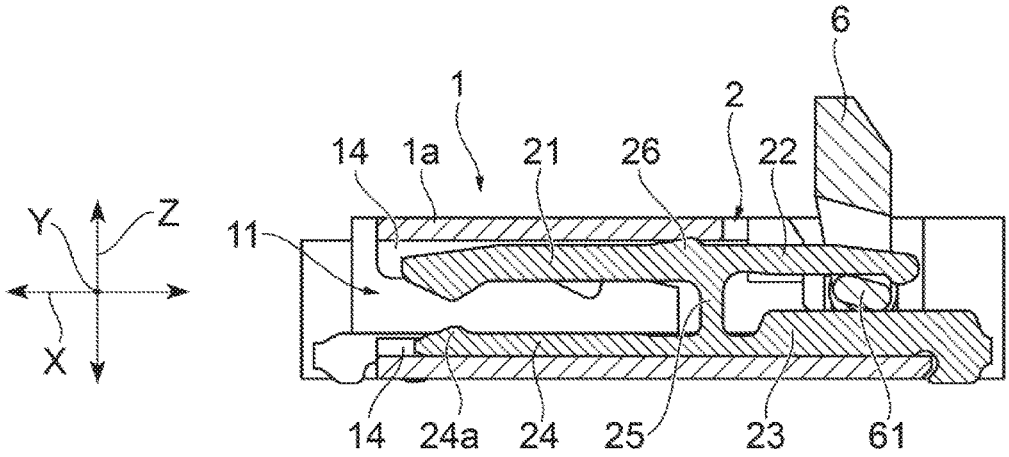
FIGS. 5(*a*) and 5(*b*) illustrate the first signal contact, wherein FIG. 5(*a*) is a sectional view of the first signal contact retained in the housing, and FIG. 5(*b*) is a perspective view of the first signal contact.
Figure 5:
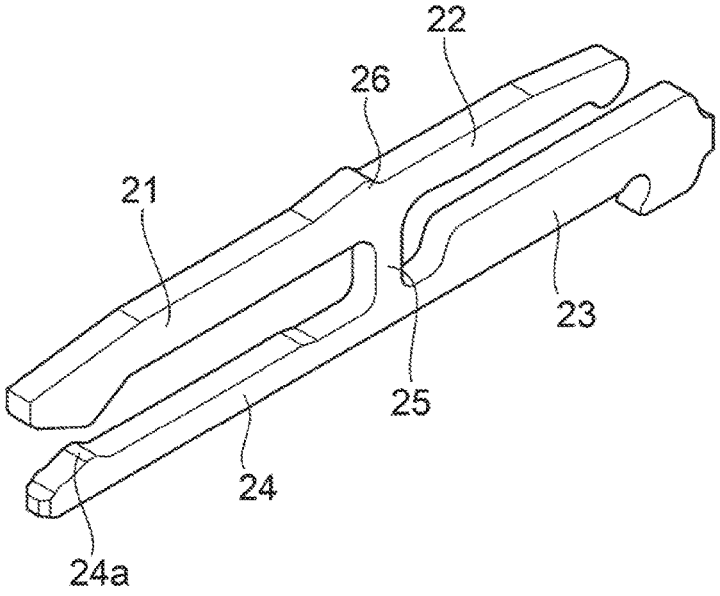
Figure 6:
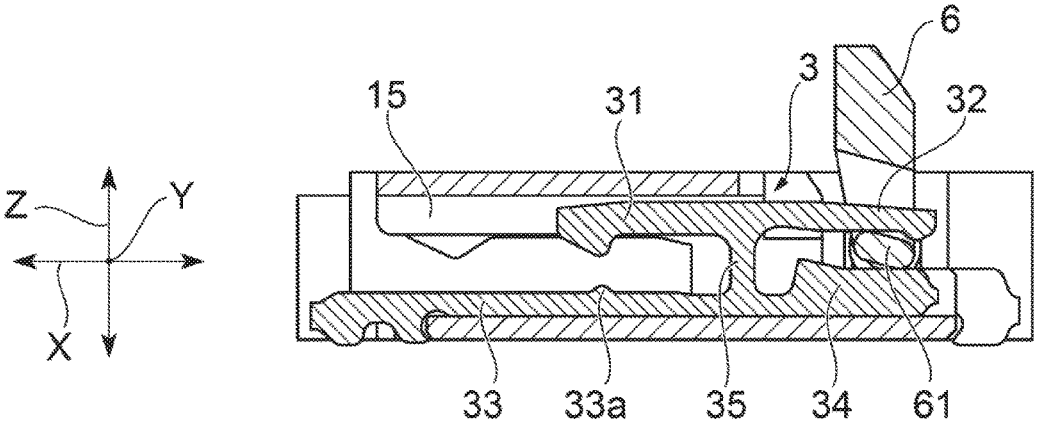
FIGS. 6(*a*) and 6(*b*) illustrate the second signal contact, wherein FIG. 6(*a*) is a sectional view of the second signal contact retained in the housing, and FIG. 6(*b*) is a perspective view of the second signal contact.
Figure 6:
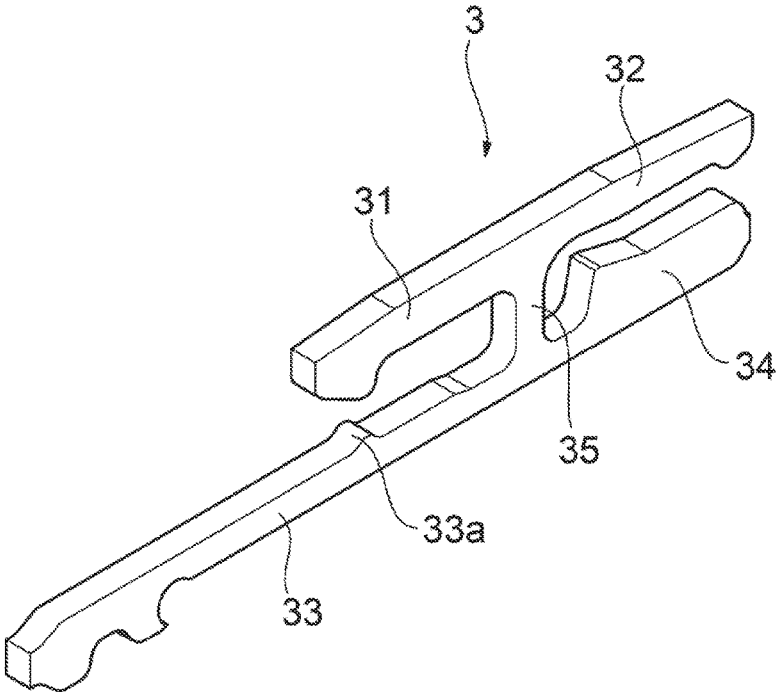
Figure 7:
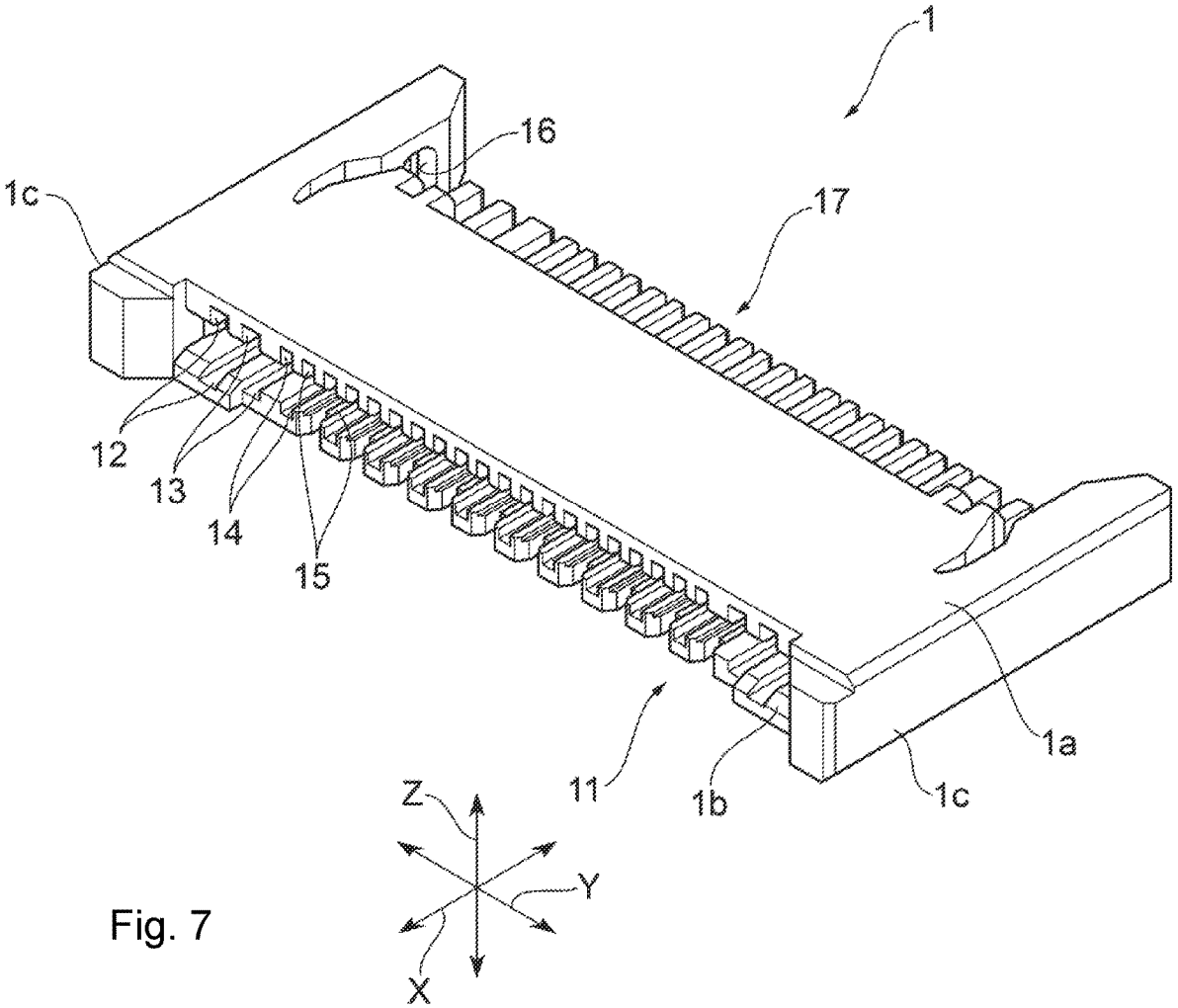
FIG. 7 is a perspective view of the housing.
Figure 8:
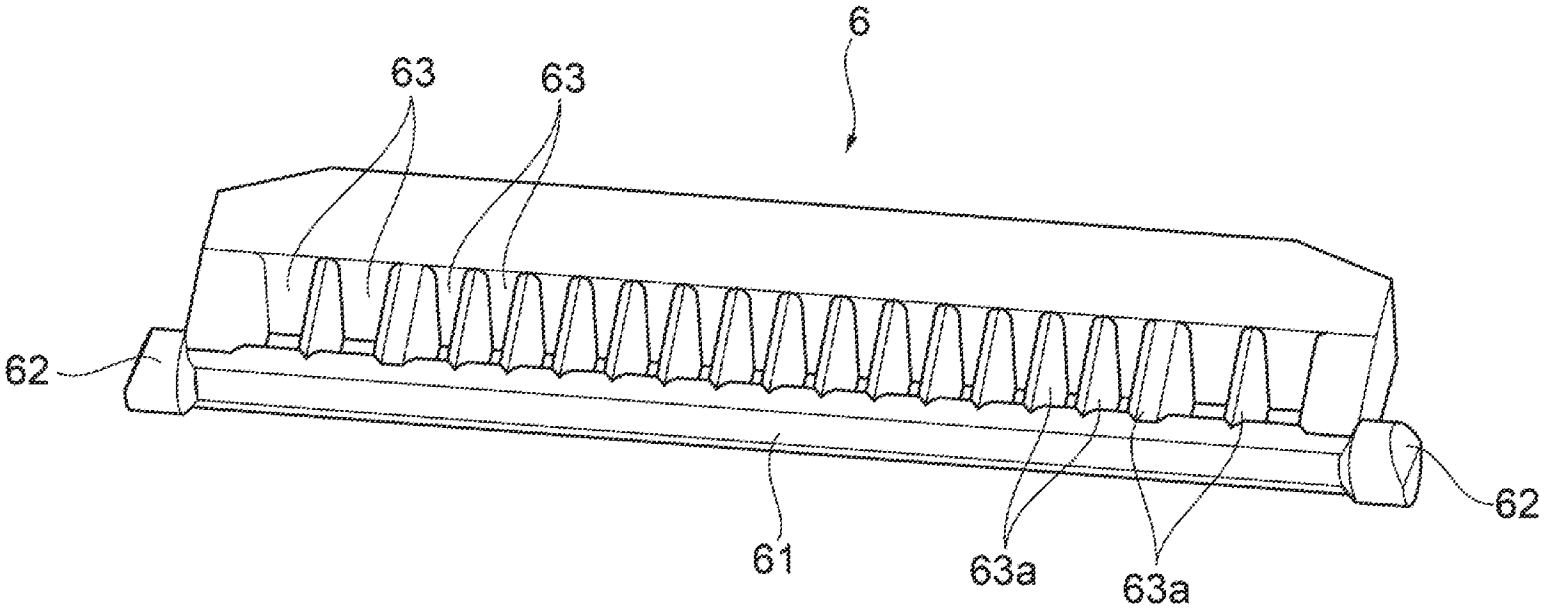
FIG. 8 is a perspective view of the pressure member.

FIG. 1 illustrates the connector 100 of the present invention shown in a perspective view, specifically, FIG. 1(*a*) illustrates the connector 100 such that an interior portion of the connector is visible by omitting an illustration of a part of the housing 1, and FIG. 1(*b*) illustrates a state in which the object F to be connected is inserted in the connector 100 illustrated in FIG. 1(*a*). FIG. 2 illustrates the power source contact 4 with a fixation function retained in the housing 1 in a sectional view, specifically, FIG. 2(*a*) illustrates the power source contact 4 with the fixation function in a case in which the pressure member 6 is located at the pressure release completion position OP, while FIG. 2(*b*) illustrates the power source contact 4 with the fixation function in a case in which the pressure member 6 is located at the pressure completion position CP. FIG. 3 illustrates the power source contact 4 with the fixation function in a perspective view, specifically, FIG. 3(*a*) illustrates the power source contact 4 with the fixation function of the first embodiment, while FIG. 3(*b*) illustrates the power source contact 4A with the fixation function of the second embodiment. FIG. 4 illustrates the simple power source contact 5, specifically, FIG. 4(*a*) illustrates the simple power source contact 5 retained in the housing 5 in a sectional view, while FIG. 4(*b*) illustrates the simple power source contact 5 in a perspective view. FIG. 5 illustrates the first signal contact 2, specifically, FIG. 5(*a*) illustrates the first signal contact 2 retained in the housing 1 in a sectional view, while FIG. 5(*b*) illustrates the first signal contact 2 in a perspective view. FIG. 6 illustrates the second signal contact 3, specifically, FIG. 6(*a*) illustrates the second signal contact 3 retained in the housing 1, while FIG. 6(*b*) illustrates the second signal contact 2 in a perspective view. FIG. 7 illustrates the housing 1 in a perspective view. FIG. 8 illustrates the pressure member 6 in a perspective view.

<Configuration of Connector>

The connector 100 mainly comprises a housing 1 having a fitting opening 11 for insertion and extraction of the object F to be connected, a desired number of signal contacts (SC) 2, 3 being retained in the housing 1 in a state of parallel disposition, and a pressure member 6 having a shape capable of being pressed to the signal contacts 2, 3. The connector 100 will be detachably fitted to an object to be connected.

The object F to be connected, which is detachably fitted to the connector 100, can be a flexible printed board (FPC), a flexible flat cable (FFC), a card with flexibility, etc.

As illustrated in FIG. 1(*b*), the object F to be connected comprises a land F2 which comes into contact with a contact portion of at least the signal contacts 2, 3 and the power source contacts 4, 5 respectively, a pattern communicating the circuit from the land F2, and a portion F1 to be engaged which engages with the power source contact (LPC) 4, with the fixation function, which is disposed at an outermost side in the alignment (parallel) direction of the contact 2, 3, 4, 5, of the power source contacts 4, 5 for preventing the object F to be connected from being extracted in a state (correct insertion position) in which the insertion of the object F to be connected is completed.

The portion F1 to be engaged is provided at both sides lateral to the insertion and extraction direction at the front side of the insertion and extraction direction of the object F to be connected in/from the connector 100. It is good if the portion F1 to be engaged is in a shape capable engaging with an engagement portion (LPC1) 42*a* of the engagement leg portion 42 of the power source contact 4 with the fixation function described later, so that the shape is not specifically limited. For example, as illustrated in FIG. 1(*b*), the object F to be connected can also be formed as a notched portion made by cutting the object F to be connected from the lateral side, otherwise as a through hole or a blind hole, depending on the art.

The housing 1 comprises a fitting opening 11 in/from which the object F to be connected is inserted/extracted and retains the signal contacts 2, 3 and the power source contacts 4, 5. It is good if the hosing 1 is formed by using an electrically isolating material, for example, the housing being formed by plastic. The housing 1 is produced as a single member by injection molding of a publicly known technique. Specifically, the material of the housing 1 is appropriately selected in consideration of the stability of dimension, ease of machining and costs, however, in general, e.g. polybutylene terephthalate (PBT), polyamide (66PA, 46PA), liquid crystal polymer (LCP), polycarbonate (PC), synthetic materials thereof etc. are to be listed.

The signal contacts 2, 3 are retained in the housing 1 and come into contact with the land F2 of the object F to be connected if the object F to be connected has been completely inserted in the housing 1 and the pressure member 6 has been moved from the pressure release completion position OP (see FIG. 2(*a*)) to the pressure completion position (CP) (see FIG. 2(*b*)). The signal contacts 2, 3 are formed as two different types, specifically, the one is a type in which the connection portion is positioned on the side opposite to the fitting opening 11 (first signal contact 2), while the other is a type in which the connection portion is positioned on the side of the fitting opening 11 (second signal contact 3).

In the contact 100 illustrated in FIG. 1, the first signal contact 2 as well as the second signal contact 3 are included, wherein the first signal contact 2 as well as the second signal contact 3 are alternately disposed in the different directions to be inserted into the housing 1.

Note that it is good to include at least one type of the first and second signal contacts 2, 3 in the connector.

As the material of the two kinds of the signal contacts 2, 3, brass, beryllium copper, phosphor bronze and the like are to be listed, since elasticity and electric conductivity are requested.

The power source contacts 4, 5 are retained at the position on the both end sides sandwiching the signal contacts 2, 3 in a pair respectively in the housing 1. The power source contacts 4, 5 form a power source connection in contact with at least the land F2 of the object F to be connected if the object F to be connected is completely inserted in the housing 1 and the pressure member 6 is moved from the pressure release completion position OP to the pressure completion position CP.

As the material of the power source contacts 4, 5, brass, beryllium copper, phosphor bronze and the like are to be listed, since elasticity and electric conductivity are requested.

The pressure member 6 comprises a portion with a shape capable of being pressed to the signal contacts 2, 3 and the power source contacts 4, 5. The pressure member 6 is made of an electrically isolating plastic and produced by injection molding of a well-known technique. Specifically, the material of the pressure member 6 is appropriately selected in consideration of the stability of dimension, ease of machining and costs etc., however, in general, polybutylene terephthalate (PBT), polyamide (66PA, 46PA), liquid crystal polymer (LCP), polycarbonate (PC) and synthetic materials thereof are to be listed.

Moreover, a main characteristic in the structure of the present invention is to aim at making the at least one pair of power source contacts 4, 5 appropriate, more specifically, the at least one pair of power source contacts 4, 5 is retained at a position on the both end sides of the housing 1 sandwiching the desired number of signal contacts 2, 3 beside the signal contacts 2, 3, wherein the at least one pair of power source contacts has a dimension of thickness larger than that of the signal contacts 2, 3, is configured to be pressed by the pressure member 6 together with the signal contacts 2, 3 and has a power source connection function, wherein the at least one pair of the power source contacts 4, 5 is the power source contact 4 with the fixation function comprising not only a power source connection function but also a function by which the object F to be connected is provisionally fixed at a correct insertion position with respect to the signal contacts 2, 3 as well as the object F to be connected is clamped and fixed in such a state of being pressed by the pressure member 6. By applying this configuration, a large current such as 0.5-3.0 A is allowed to flow in the connector 100 without increasing the resistance value of the connector 100, as well as a separate member for engagement of the object F to be connected is not necessary to be provided. Thereby, the number of the members to be provided in the housing 1 of the connector 100 can be decreased and a space-saving of the connector 100 can be achieved.

Furthermore, if the at least one pair of the power source contacts 4, 5 is composed of one pair of the power source contacts 4 with the fixation function and at least one pair of simple power source contacts (NPC) 5 positioned between the pair of the power source contacts 4 with the fixation function and the desired number of the signal contacts 2, 3 respectively, a large current is allowed to flow while further suppressing the resistance value of the connector 100.

Note that the simple power source contact 5 is positioned outside the power source contact 4 with the fixation function, namely, on the side opposite to the signal contacts 2, 3 of the power source contact 4 with the fixation function respectively.

[Power Source Contact with a Fixation Function]

In the following, the first embodiment of the power source contact 4 with a fixation function will be described with reference to FIGS. 2 and 3.

The power source contact 4 with a fixation function comprises a power source connection function as well as a fixation function with respect to the object F to be connected, is retained along the insertion direction X of the object F to be connected at the housing 1, and disposed in pairs at the outermost side of the alignment direction (width direction) of the contacts 2, 3, 4, 5 in the housing 1. The power source contact 4 with the fixation function is retained in the grooves 12 positioned at the both ends among the grooves formed at the interior surface of the housing 1 facing the height direction Z of the housing 1 and partitioned by the wall portion by press-fitting. The power source contact 4 with the fixation function is inserted from the side opposite to the fitting opening 11 in the housing 1.

It is preferable that the dimension of thickness of the power source contact 4 with the fixation function is larger than the dimension of thickness of the signal contacts 2, 3 and is specifically 0.10-0.20 mm.

Here, the "dimension of thickness" means a thickness of the power source contact 4 with the fixation function along the alignment direction Y of the contacts 2, 3, 4, 5, in other words, the thickness of the base material of the power source contact 4 with the fixation function.

As illustrated in FIGS. 1, 2 and 3(*a*), the power source contact 4 with the fixation function comprises: —a contact portion (LPC1) 41*a*, which comes into contact with at least one of the both surfaces of the object F to be connected; —an engagement portion (LPC2) 42*a*, which has a shape protruding toward a portion F1 to be engaged at a position corresponding to the portion F1 to be engaged formed at the inserted object F to be connected; —a coupling portion (LPC5) 45*a*, which couples the contact portion 41*a* and the engagement portion 42*a*; —a pressure receiving portion (LPC3) 43*a*, which extends from one end side of the coupling portion 45*a* to a side opposite to the contact portion 41*a* and is pressed by the pressure member 6; and —a connection portion (LPC4) 44*a*, which extends from the other end side of the coupling portion 45*a* to a side opposite to the engagement portion 42*a* and is connected to a substrate.

More specifically, the power source contact 4 with the fixation function integrally comprises a power source connection leg portion 41 having a contact portion 41*a*, an engagement leg portion 42 having an engagement portion 42*a*, a pressure receiving leg portion 43 having a pressure receiving portion 43*a*, a connection leg portion 44 having a connection portion 44*a*, and a coupling leg portion 45 having a coupling portion 45*a*, so as to be entirely in a H-shape. In particular, in the positional relation between the power source connection leg portion 41, the coupling leg portion 45 and the connection leg portion 44, an essentially crank-shape is formed.

The object F to be connected is inserted between the power source connection leg portion 41 and the engagement leg portion 42, and the pressure portion 61 of the pressure member 6 is rotatably supported between the pressure receiving leg portion 43 and the connection leg portion 44.

The power source connection leg portion 41 comes into contact with the land portion F2 of the object F to be connected so as to achieve a power source connection.

The power source connection leg portion 41 is located in the groove 12 on the side of an upper wall portion 1*a* of the housing 1 and positioned on the side of the fitting opening 11 of the housing 1 with respect to the coupling leg portion 45. Namely, the power source connection leg portion 41 extends from the coupling leg portion 45 toward the fitting opening 11. The tip end portion on the side of the fitting opening 11 of the power source connection leg portion 41 floats from the bottom surface of the groove 12 and comprises a contact portion 41*a* to come into contact with at least one of the surfaces of the object F to be connected. The contact portion 41*a* comprises a shape protruding toward the engagement leg portion 42 so as to easily come into contact with the object F to be connected.

At the time of movement of the pressure member 6 from the pressure release completion position OP to the pressure completion position CP, the power source connection leg portion 41 is pressed toward the object F to be connected so as to come into a secure and stable electrical contact.

As illustrated in FIG. 1(*b*), the engagement leg portion 42 engages with a portion F1 to be engaged formed at the object F to be connected and prevents the object F to be connected from being inconveniently extracted by provisionally fixing the object F to be connected located at the correct insertion position.

The engagement leg portion 42 is located on the side facing the power source connection leg portion 41 in the groove 12 on the side of a lower wall portion 1*b* of the housing 1 and positioned on the side of the fitting opening 11 of the housing 1 with respect to the coupling leg portion 45. Namely, the engagement leg portion 42 extends from the coupling leg portion 45 toward the fitting opening 11. Furthermore, the engagement leg portion 42 is retained in the groove 12 in such a state that the surface portion on the side facing the power source connection leg portion 41 is exposed over the entire length. Namely, the engagement leg portion 42 is retained in the groove 12 such that the entire length is visible from the side of the fitting opening 11.

The engagement leg portion 42 comprises an engagement portion 42*a* in a shape protruding toward the portion F1 to be engaged at a position corresponding to the portion F1 to be engaged formed at the object F to be connected inserted in the housing 1. Namely, the engagement portion 42*a* is provided at the position corresponding to the portion F1 to be engaged at the time of completion of the insertion of the object F to be connected. The engagement portion 42*a* is provided on the side of the tip end portion of the engagement leg portion 42 and is formed such that the engagement portion 42*a* is inclined from the tip end portion of the engagement leg portion 42 upward in a taper shape and runs essentially perpendicular from an intermediate position back to the engagement leg portion 42. The engagement portion 42*a* of the engagement leg portion 42 protrudes from the groove 12 on the side of the lower wall portion 1*b* toward the upper wall portion 1*a* of the retaining housing 1.

The power source contact 4 with the fixation function comprises a facing contact portion (LPC6) 42*b* between the engagement portion 42*a* and the connection portion 45*a* to be in contact with the object F to be connected. Specifically, the facing contact portion 42*b* is in contact with the object F to be connected on a surface opposed to the surface at which the contact portion 41*a* of the power source connection leg portion 41 is in contact with the object F to be connected, at a position facing the contact portion 41*a* of the power source connection leg portion 41 in the height direction Z of the housing 1. The facing contact portion 42*b* comprises a shape protruding toward the contact portion 41*a* of the power source connection leg portion 41.

The facing contact portion 42*b* of the engagement leg portion 42 may also be provided at a position offset from the position facing the contact portion 41*a* of the power source connection leg portion 41 in the height direction Z of the housing 1 to the extending direction of the engagement leg portion 42 as far as the facing contact portion 42*b* of the engagement leg portion 42 comes into contact with the object F to be connected.

It is good to appropriately design the shape and the size of the engagement portion 42*a* in consideration of the retaining force, the strength and ease of machining of the object F to be connected and the reduced height of the connector 100, as far as the engagement portion 42*a* comes into contact with the portion F1 to be engaged of the object F to be connected.

The pressure receiving leg portion 43 is a portion pressed by a pressure portion 61 of a pressure member 6 and deformed upward.

The pressure receiving leg portion 43 is located on the side facing the connection leg portion 44 on the side of the upper wall portion 1*a* of the housing 1, and positioned on the side opposite to the fitting opening 11 of the housing 1 with respect to the coupling leg portion 45. Namely, the pressure receiving leg portion 43 extends from the coupling leg portion 45 to the side opposite to the fitting opening 11.

The pressure receiving leg portion 43 comprises a pressure receiving portion 43*a* pressed by the pressure member 6.

In consideration of the reduction of the height of the connector 100, it is preferable that at least a portion of the pressure receiving portion 43*a* which is pressed by the pressure portion 61 of a pressure member 6 is configured to be flat. In the above configuration, the pressure member 6 is rotatable between the pressure release completion position OP and the pressure completion position CP without comprising a certain shaft portion supported by the housing 1. Namely, the rotational axis of the pressure portion 61 of a pressure member 6 is movable along the flat-shaped portion of the pressure receiving leg portion 43, namely, along the pressure receiving portion 43*a* with the rotation of the pressure member 6.

Furthermore, it is preferable to comprise a swelling prevention means at a tip end portion of the pressure receiving portion 43*a* which prevents the pressure member 6 from swelling and moving into a direction opposite to the fitting opening 11 of the housing 1 resulting from repulsion to a pressure of the pressure member 6. Specifically, a protrusion portion 43*b* protruding toward the connection leg portion 44 is provided at the tip end portion of the pressure receiving leg portion 43 for preventing the pressure member 6 from swelling and moving. At the time of the rotation of the pressure member 6, a central portion of the pressure member 6 in the width direction Y of the housing 1 tends to swell in the direction opposite to the fitting opening 11 of the housing 1. However, this tendency can be prevented by the protrusion portion 43*b* of the pressure receiving leg portion 43.

The size of the protrusion portion 43*b* is not limited as far as the above role can be performed, and can be appropriately designed such that the pressure portion 61 of the pressure member 6 can partially engage. Furthermore, as a swelling prevention means, it is possible to provide a groove (concave portion) besides the above configuration, so as to accept the pressure portion 61.

If the protrusion portion 43*b* is provided, the description "at least a portion which is pressed by the pressure portion 61 of a pressure member 6 is configured to be flat" means that a portion of the pressure receiving leg portion 43 other than the portion at which the protrusion portion 43*b* is formed is configured to be flat. The term "flat" means that the rotational axis can be moved when the pressure member 6 is rotated, thus, it does not only mean that there is no roughness but it is also allowed that there are some waves, curves and some roughness.

The connection leg portion 44 is a portion to be mounted at the substrate.

The connection leg portion 44 is located on the side facing the pressure receiving leg portion 43 in the groove 12 on the side of the lower wall portion 1*b* of the housing 1, and positioned on the side opposite to the fitting opening 11 of the housing 1 with respect to the coupling leg portion 45. Namely, the connection leg portion 44 extends from the coupling leg portion 45 to the side opposite to the fitting opening 11. The connection leg portion 44 comprises a connection portion 44*a* to be connected to the substrate. The connection portion 44*a* is formed on the side opposite to the side facing the pressure receiving leg portion 43 on the tip end side of the connection leg portion 44. In the embodiment illustrated in the drawing, the connection portion 44*a* is a portion of the surface mounted type (SMT), but can be a portion of the DIP-mount type.

In consideration of the reduction of the height of the connector 100, it is preferable that at least a portion of the connection leg portion 44 which is pressed by the pressure portion 61 of the pressure member 6 is configured to be flat. The effect of the flat shape of the portion is equal to that of the pressure receiving portion 43*a* of the pressure receiving leg portion 43.

It is preferable that a portion of the power source contact 4 with the fixation function located between the connection portion 44*a* and the coupling portion 45*a* has a width dimension larger than the thickness dimension of the power source contact 4 with the fixation function. Specifically, the portion of the connection leg portion 44 extending from the coupling leg portion 45 in a small distance to the connection portion 44*a* has a dimension in the height direction Z of the housing 1 larger than the dimension of the power source contact 4 with the fixation function in the width direction Y of the housing 1.

Furthermore, it is also good to provide a swelling prevention means to prevent from swelling and moving at the tip end potion of the connection leg portion 44, specifically, a protrusion portion (not shown) protruding toward the pressure receiving leg portion 43. The structure, function, and art of the protrusion portion of the connection leg portion 44 is equal to those of the protrusion portion 43*b* portion of the pressure receiving leg portion 43.

Furthermore, as a swelling prevention means, it is possible to provide a groove (concave portion) besides the above configuration, so as to accept the pressure portion 61. Note that it is good to provide the swelling prevention means at least one of the pressure receiving leg portion and the connection leg portion.

The coupling leg portion 45 comprises a connection portion 45*a* which is mutually coupled to the power source connection leg portion 41, the engagement leg portion 42, the pressure receiving leg portion 43, and the connection leg portion 44. For the convenience of description, the coupling portion 45*a* is described as a portion which mutually couples each leg portions 41-44. However, the coupling portion 45*a* is not clearly distinguished from the coupling leg portion 45 since the power source contact 4 with the fixation function is a single member. Furthermore, there is no clear distinction of the boundaries between the above leg portions 41-45 respectively.

The power source contact 4 with the fixation function comprises a press-fitting fixation portion 46 having a shape protruding toward the inner surface of the housing 1 between the contact portion 41*a* and the pressure receiving portion 43*a* so as to be pressed and fixed in the housing 1. The press-fitting fixation portion 46 is formed to protrude toward the upper wall portion 1*a* of the housing 1. Thereby, the power source contact 4 with the fixation function is pressed and retained in the housing 1 in the height direction Y of the housing 1 so as to maintain the insertion position.

Note that the positional relation between the power source connection leg portion 41 and the engagement leg portion 42 may be reversed. Namely, it is also good that the power source connection leg portion 41 is in the groove 12 on the side of the lower wall portion 1*b* of the housing 1, and the engagement leg portion 42 is in the groove 12 on the side of the upper wall portion 1*a* of the housing 1.

Next, the second embodiment of the power source contact with the fixation function will be described with reference to FIG. 3(*b*).

In the following, the description of the structure with a function equal or similar to that of the power source contact 4 with the fixation function of the above first embodiment will be omitted, and the different structure will be mainly described.

The power source contact 4A with the fixation function of the second embodiment is inserted from the side of the fitting opening 11 into the housing 1.

The power source contact 4A with the fixation function comprises: —a contact portion 41Aa, which comes into contact with at least one of the both surfaces of the object F to be connected; —an engagement portion 42Aa, which has a shape protruding toward a portion F1 to be engaged at a position corresponding to the portion F1 to be engaged formed at the inserted object F to be connected; —a coupling portion 45Aa, which couples the contact portion 41Aa and the engagement portion 42Aa; —a pressure receiving portion 43Aa, which extends from one end side of the coupling portion 45Aa to a side opposite to the contact portion 41Aa and is pressed by the pressure member 6; and —a connection portion 44Aa, which extends from the engagement portion 42Aa toward a side of the fitting opening 11 and is connected to a substrate.

Similar to the power source contact 4 with the fixation function according to the first embodiment, the power source contact 4A with the fixation function integrally comprises a power source connection leg portion 41A having the contact portion 41Aa, an engagement leg portion 42A having the engagement portion 42Aa, a pressure receiving leg portion 43A having the pressure receiving portion 43Aa, a connection leg portion 44A having the connection portion 44Aa, and a coupling leg portion 45A having the coupling portion 45Aa, so as to be entirely in an h-shape.

The connection leg portion 44A of the power source contact 4A with the fixation function is positioned on a side opposite to the coupling leg portion 45A from the tip end side of the engagement leg portion 42A, and on the side more closed to the tip end side of the engagement leg portion 42A than the engagement portion 42Aa. Furthermore, the engagement leg portion 42A and the connection leg portion 44A are retained in the groove 12 in such a state that the surface portion on the side facing the power source connection leg portion 41A is exposed over the entire length.

Namely, the engagement leg portion 42A and the connection leg portion 44A are retained in the groove 12 such that the entire length is visible from the side of the fitting opening 11.

In the power source contact 4A with the fixation function, the pressure member 6 is supported between the pressure receiving leg portion 43A and lower wall portion 1*b* of the housing 1. In this case, it is preferable that a portion of lower wall portion 1*b* of the housing 1 which supports the pressure member 6 is configured to be flat.

Furthermore, it is also good that the power source contact 4A with the fixation function comprises an extended leg portion on the side same as the engagement leg portion 42A, which is although not shown, in the height direction Z of the housing 1, and on the side facing the pressure receiving leg portion 43A of the power source contact 4A with the fixation function. The extended leg portion supports the rotation of the pressure portion 61 of the pressure member 6 together with the pressure receiving leg portion 43A. In this case, it is preferable that a portion which supports the pressure portion 61 of the pressure member 6 is configured to be flat.

Furthermore, the power source contact 4A with the fixation function comprises a press-fitting fixation portion 46A having a shape protruding toward the inner surface of the housing 1 between the contact portion 41Aa and the pressure receiving portion 43Aa so as to be pressed and fixed in the housing 1.

In the connector 100 of the present invention, the power source contact 4 with the fixation function is used. However, at least one of the power source contact 4 with the fixation function and the power source contact 4A with the fixation function can be used.

[Simple Power Source Contact]

Next, the simple power source contact 5 will be described with reference to FIG. 4. The simple power source contact 5 comprises only a power source connection function as a main function, thus, the simple power source contact 5 does not comprise such a fixation function which the power source contact 4 with the fixation function comprises.

Since the portions of the simple power source contact 5 denoted equal to those which the power source contact 4 with the fixation function comprises have a structure and a function equal to those of the power source contact 4 with the fixation function, the description thereto will be omitted.

It is preferable that the dimension of thickness of the simple power source contact 5 is larger than the dimension of thickness of the signal contacts 2, 3 and is specifically 0.10-0.20 mm.

Here, the "dimension of thickness" has a same meaning as that of the power source contact 4 with the fixation function.

The simple power source contact 5 comprises a power source connection function with respect to the object F to be connected, and disposed along the alignment direction Y of the contact between the signal contacts 2, 3 and the power source contact 4; 4A with the fixation function. The simple power source contact 5 is retained by being pressed in the groove 13 (see FIG. 7) of the grooves formed at the interior surface of the housing 1 facing the height direction Z of the housing 1 and partitioned by the wall portion. The simple power source contact 5 is inserted from the side opposite to the fitting opening 11 into the housing 1.

The simple power source contact 5 comprises: —a contact portion (NPC1) 51*a*, which comes into contact with at least one of both surfaces of the object F to be connected located in the correct insertion position; —a pressure receiving portion (NPC2) 52*a*, which is pressed by a pressure member 6; —a connection portion (NPC3) 53*a*, which is connected to a substrate; and —a coupling portion (NPC4) 54*a*, which couples the contact portion 51*a*, the pressure receiving portion 52*a* and the connection portion 53*a*; wherein the contact portion 51*a* and the pressure receiving portion 52*a* extend from one end side of the coupling portion 54*a* to the mutually opposite sides, and the connection portion 53*a* extends from the other end side of the coupling portion 54*a* to the side opposite to the fitting opening 11.

More specifically, the simple power source contact 5 entirely and integrally comprises a power source connection leg portion 51 having the contact portion 51*a*, a pressure receiving leg portion 52 having the pressure receiving portion 52*a*, a connection leg portion 53 having the connection portion 53*a*, and a coupling leg portion 54 having the coupling portion 54*a*. Furthermore, different to the power source contact 4, 4A with the fixation function, the simple power source contact 5 does not comprise an engagement leg portion, but comprises an extended leg portion 55 instead, which extends from one end side of the coupling leg portion 54 toward the side of the fitting opening 11 so as to be entirely formed in a H-shape.

Furthermore, the simple power source contact 5 comprises a press-fit fixation portion 56 having a shape protruding toward the interior surface of the housing 1 between the contact portion 51*a* and the pressure receiving portion 52*a* so as to be pressed and fixed in the housing 1. Furthermore, it is also good that the simple power source contact 5 comprises a facing contact portion (NPC 5) to be in contact with a surface of the object F to be connected, separate to the contact portion 51*a*, which is although not shown. Furthermore, it is preferable that a portion of the pressure receiving portion 52*a* of the simple power source contact 5 which is pressed at least by the pressure member 6 is configured to be flat. Furthermore, the simple power source contact 5 comprises a swelling prevention means at a tip end portion of the pressure receiving portion 52*a* which prevents the pressure member 6 from swelling and moving in a direction opposite to the fitting opening 11 of the housing 1 resulting from repulsion to a pressure by the pressure member 6, specifically, a protrusion portion 52*b* protruding toward the connection leg portion 53.

It is also good to provide the connection leg portion 53 of the simple power source contact 5 at a position of the extended leg portion 55, namely, the simple power source contact 5 may extend from the other end side of the coupling portion 54*a* toward the side of the fitting opening 11

Furthermore, the extended leg portion 55 is retained in the groove 13 in such a state that the surface portion on the side facing the power source connection leg portion 51 is exposed over the entire length. Namely, the extended leg portion 55 is retained in the groove 13 such that the entire length is visible from the side of the fitting opening 11.

Furthermore, the positional relation between the power source connection leg portion 51 and the engagement leg portion 52 may be reversed. Namely, it is also good that the power source connection leg portion 51 is in the groove 13 on the side of the lower wall portion 1*b* of the housing 1, and the engagement leg portion 52 is in the groove 13 on the side of the upper wall portion 1*a* of the housing 1.

Furthermore, it is not necessary to provide the simple power source contact 5 as far as a current desired by the connector 100 is achieved only by the power source contact 4, 4A with the fixation function within a range of a predetermined resistance value.

[Signal Contact]

(First Signal Contact)

Next, the first signal contact 2 will be described with reference to FIG. 5. Since the portions of the first signal contact 2 denoted equal to those which the power source contact 4 with the fixation function comprises have a structure and a function equal to those of the power source contact 4 with the fixation function, the description thereto will be omitted.

A desired number of the first signal contacts 2 is retained in the housing 1, in a state of parallel disposition, and disposed between the power source contacts 4; 4A, 5. The first signal contact 2 is retained by being pressed in the groove 14 among the grooves formed at the interior surface facing the height direction Z of the housing and partitioned by the wall portion. The first signal contact 2 is inserted from the side opposite to the fitting opening 11 into the housing 1.

The first signal contact 2 integrally comprises a contact leg portion 21 to be in contact with the object F to be connected, a pressure receiving leg portion 22 to be pressed by the pressure member 6, a connection leg portion 23 to be mounted on a substrate, an extended leg portion 24, and a coupling leg portion 25 to couple each leg portions 21-24 so as to be entirely in an H-shape.

Different to the power source contact 4 with the fixation function, the first signal contact 2 does not comprise an engagement leg portion, but comprises an extended leg portion 24 instead, which extends from one end side of the coupling leg portion 25 toward the side of the fitting opening 11 so as to be entirely formed in an H-shape.

In the first signal contact 2, the object F to be connected is inserted between the contact leg portion 21 and the extended leg portion 24, and the pressure portion 61 of the pressure member 6 is rotatably supported between the pressure receiving leg portion 22 and the connection leg portion 23.

The extended leg portion 24 is retained in the groove 14 in such a state that a surface portion on the side facing the contact leg portion 21 is exposed over the entire length. Specifically, the extended leg portion 24 is retained in the groove 14 in such a state that a surface portion on the side facing the contact leg portion 21 is exposed over the entire length such that the entire length is visible from the side of the fitting opening 11.

It is also good to provide a contact portion to be in contact with the object F to be connected at a position facing the contact leg portion 21 on the side facing the contact leg portion 21 of the extended leg portion 24. Namely, it is also good that the first signal contact 2 clamps the object F to be connected by the contact leg portion 21 and the extended leg portion 24. The extended leg portion 24 has a structure equal to that of the contact leg portion 21 and comprises a facing contact portion 24*a* to be in contact with the object F to be connected. The facing contact portion 24*a* comprises a shape of a protrusion portion to be in an easy contact with the object F to be connected and protrudes toward the contact leg portion 21.

Furthermore, the first signal contact 2 comprises a press-fit fixation portion 26 having a shape protruding toward the interior surface of the housing 1 between the contact leg portion 21 and the pressure receiving leg portion 22 so as to be pressed and fixed in the housing 1.

(Second Signal Contact)

Next, the second signal contact 3 will be described with reference to FIG. 6. Since the portions of the second signal contact 3 denoted equal to those which the first signal contact 2 comprises have a structure and a function equal to those of the first signal contact 2, the description thereto will be omitted.

A desired number of the second signal contacts 3 is retained in the housing 1, in a state of parallel disposition, and disposed between the power source contacts 4; 4A, 5. The second signal contact 3 is retained by being pressed in the groove 15 among the grooves formed at the interior surface facing the height direction Z of the housing 1 and partitioned by the wall portion. The second signal contact 3 is inserted from the side of the fitting opening 11 into the housing 1.

The second signal contact 3 integrally comprises a contact leg portion 31 to be in contact with the object F to be connected, a pressure receiving leg portion 32 to be pressed by the pressure member 6, a connection leg portion 33 to be mounted on a substrate, an extended leg portion 34, and a coupling leg portion 35 to couple each leg portions 31-34 so as to be entirely in an H-shape.

In the second signal contact 3, different to the first signal contact 2, the connection leg portion 33 is positioned at a position of the extended leg portion 24 of the first signal contact 2, and the extended leg portion 34 is positioned at a position of the connection leg portion 23 of the first signal contact 2.

In the second signal contact 3, the object F to be connected is inserted between the contact leg portion 31 and the connection leg portion 33, and the pressure portion 61 of the pressure member 6 is rotatably supported between the pressure receiving leg portion 32 and the extended leg portion 34.

The connection leg portion 33 comprises a facing contact portion 33*a* to be in contact with the object F to be connected. The facing contact portion 33*a* comprises a shape of a protrusion portion to be in an easy contact with the object F to be connected and protrudes toward the contact leg portion 31.

[Housing]

Next, the specific configuration of the housing 1 will be described with reference to FIG. 7.

The housing 1 comprises an upper wall portion 1*a* and a lower wall portion 1*b* positioned facing the height direction Z of the housing 1, and two side wall portions 1*c* which couple the upper wall portion 1*a* and the lower wall portion 1*b*. The fitting opening 11 of the housing 1 is formed by being enclosed by the upper wall portion 1*a*, the lower wall portion 1*b* and the two side wall portions 1*c*.

The housing 1 comprises a plurality of grooves to retain the signal contacts 2, 3, the power source contacts 4, 4A with the fixation function, and the simple power source contact 5 respectively.

The above grooves are formed at the respective facing positions of the interior surface of the upper wall portion 1*a* and the lower wall portion 1*b* facing the height direction Z of the housing 1 as a groove 12 to retain the power source contacts 4; 4A with the fixation function, a groove 13 to retain the simple power source contact 5, and grooves 14, 15 to retain the signal contacts 2, 3. Each grooves 12, 13, 14, 15 are formed in the extending direction of the contacts 2, 3, 4; 4A, 5 (X-direction) respectively penetrating through the housing 1.

The signal contacts 2, 3, the power source contacts 4; 4A with the fixation function, and the simple power source contact 5 are fixed in the corresponding grooves 14, 15, 12, 13 for example by means of press-fitting, hooking (lancing), welding or the like.

Furthermore, a concave support portion 16 is provided to rotatably support the pressure member 6 at both sides in the width direction Y of the housing 1, namely, the side wall portions 1*c*, of the housing 1. It is good to design the shape and the size of the support portion 16 such that the pressure member 6 is rotatably mounted on the housing 1 in consideration of the role of the pressure member 6 and the strength, the size and others of the housing 1.

Moreover, a notched portion 17 is formed at the upper wall portion 1*a* of the housing 1. By the presence of the notched portion 17, the upward displacement of the pressure receiving leg portions 22, 32, 43: 43A, 52 of the contacts 2, 3, 4; 4A, 5 is not interrupted when the pressure member 6 presses the first and second signal contacts 2, 3 and the power source contacts 4; 4A, 5 when moving from the pressure release completion position OP to the pressure completion position CP. Furthermore, by providing the notched portion 17, the height of the connector 100 can also be reduced. The size of the notched portion 17 will be appropriately designed in consideration of the above role, the reduced height, ease of machining, strength and others of the connector 100.

[Pressure Member]

Next, the pressure member 6 will be described with reference to FIG. 8.

The pressure member 6 rotates between the pressure release completion position OP (see FIG. 1(*a*)), at which the object F to be connected is able to be inserted/extracted in/from the housing 1, and the pressure completion position CP (FIG. 1(*b*)), at which the pressure contact state of the first and second signal contacts 2, 3, the power source contacts 4; 4A with the fixation function, and the simple power source contact 5 with respect to the object F to be connected is stably kept.

In the embodiment as illustrated, the pressure member 6 is composed of: —a pressure portion 61 to press the pressure receiving leg portions 22, 32 of the first and second signal contacts 2, 3, the pressure receiving leg portions 43; 43A of the power source contacts 4; 4A with the fixation function, and the pressure receiving leg portion 53 of the simple power source contact 5, —a shaft portion 62 which is rotatably attached to the support portion 16 of the side wall portions 11*c* on a side opposite to the fitting opening 11 of the housing 1, and an engagement hole 63 in which the pressure receiving leg portions 22, 32 of the first and second signal contacts 2, 3, the pressure receiving leg portions 43; 43A of the power source contact 4; 4A with the fixation function, and the pressure receiving leg portion 52 of the simple power source contact 5 individually engage.

The pressure portion 61 is a portion to press the pressure receiving leg portion 22 of the first signal contact 2, the pressure receiving leg portion 32 of the second signal contact 3, the pressure receiving leg portions 43; 43A of the power source contacts 4; 4A with the fixation function, and the pressure receiving leg portion 52 of the simple power source contact 5 so as to lift the above leg portions upward.

The pressure portion 61 is rotatably supported between the pressure receiving leg portion 22 and the connection leg portion 24 of the first signal contact 2, the pressure receiving leg portion 32 and the extended leg portion 34 of the second signal contact 3, the pressure receiving leg portion 43 and the connection leg portion 44 of the power source contacts 4 with the fixation function, and the pressure receiving leg portion 52 and the connection leg portion 53 of the simple power source contact 5.

In case of use of the power source contacts 4A with the fixation function of the second embodiment, the pressure portion 61 is rotatably supported between the pressure receiving portion leg 43A and the extended leg portion, if an extended leg portion is provided, and the pressure portion 61 is rotatably supported between the pressure receiving portion 43A and the corresponding lower wall portion 1*b* of the housing 1, if the extended leg portion is not provided.

It is good that a portion of the pressure portion 61 which is in contact with at least the first and second signal contacts 2, 3, the power source contact 4, 4A with the fixation function, the simple power source contact 5, or the lower wall portion 1*b* of the housing 1 comprise an arc portion 61*a* (see FIG. 2(*b*)). Specifically, the arc portion 61*a* is formed corresponding to the rotational area between the pressure release completion position OP and the pressure completion position CP of the pressure member 6. The curvature of the arc portion 61*a* may be constant or variable. The pressure portion 61 comprises a shape having a major axis and a minor axis, for example, an elongated or elliptical shape is also available.

The shaft portion 62 is fitted to the support portion 16 of the side wall portions 11*c* of the housing 1, and serves as a portion to allow the pressure member 6 to smoothly rotate between the pressure release completion position OP and the pressure completion position CP.

It is not necessary to provide the shaft portion 62 as far as the pressure portion 61 is properly supported by the first and second signal contacts 2, 3, the power source contact 4; 4A with the fixation function and the simple power source contact 5 and the rotational movement of the pressure member 6 can be carried out without any interruption.

The engagement hole 63 is a hole to prevent the middle portion of the pressure member 6 from swelling to the side opposite to the fitting opening 11 when the pressure member 6 is rotating. The engagement holes 63 are mutually partitioned by wall portions 63*a* so as to be individually and separately provided. By individually and separately providing the engagement holes 63, the rigidity of the pressure member 6 is enhanced, so as to prevent the pressure member 6 from being deformed when the pressure member 6 is rotating.

<Operation of the Power Source Contact with the Fixation Function>

Next, the operation of the power source contact 4 with the fixation function having the above configuration will be described with reference to FIGS. 2(*a*) and 2(*b*), the operation at the time of being pressed by the pressure member 6. Note that the illustration of the object F to be connected is omitted from the perspective of easy viewing of the drawings.

The object F to be connected is able to be inserted between the power source connection leg portion 41 and the engagement leg portion 42 of the power source contact 4 with the fixation function when the pressure member 6 is located at the pressure release completion position OP. If the object F to be connected is inserted, the power source connection leg portion 41 is in an electrical contact with a land portion F2 of the object F to be connected. In a state in which the pressure member 6 is located at the pressure release completion position OP, the power source connection leg portion 41 is certainly in an electrical contact with the object F to be connected, however, the contact is not stable.

Thus, the pressure member 6 is moved to the pressure completion position CP illustrated in FIG. 2(*b*) so as to stabilize the electrical connection between the power source contact 4 with the fixation function and the object F to be connected, as well as surely prevent the object F to be connected from being extracted. Specifically, if the pressure member 6 is moved from the pressure release completion position OP to the pressure completion position CP, the pressure receiving leg portion 43 of the power source contact 4 with the fixation function is inclinedly displaced by being lifted up by the pressure portion 61 of the pressure member 6. In accordance with the upward displacement of the pressure receiving leg portion 43, the power source connection leg portion 41 is inclinedly displaced downward. In accordance with the downward displacement of the power source connection leg portion 41, the power source connection leg portion 41 is pressed to come into contact with the object F to be connected at the contact portion 41*a* so as to achieve an electrically stable contact. The position of the power source connection leg portion 41 and the pressure receiving leg portion 43 before the inclined displacement is illustrated in FIG. 2(*b*) with a two-dot line.

Furthermore, in accordance with the downward displacement of the power source connection leg portion 41, the power source connection leg portion 41 is pressed to come into contact with the object F to be connected at the contact portion 41*a*. Since the object F to be connected is pressed downward by being pressed by the power source connection leg portion 41, the object F to be connected firmly engages with the engagement portion 42*a* of the engagement leg portion 42 at the portion F1 to be engaged to surely prevent the object F to be connected from being extracted. Thereby, a stable electrical contact between the power source connection leg portion 41 and the object F to be connected will be achieved.

EXAMPLE

In the following, the resistance value Ω of the connector (Embodiment 1) having the above configuration and that of another connector (Comparison example 1) are compared, on the basis of the voltage drop in case of the power source current flow.

Example 1

The configuration of Example 1 is as follows.

One pair of the power source contacts 4 with the fixation function of the present invention is disposed at the both ends of the housing and one pair of the simple power source contacts 5 is disposed between the pair of the power source contacts 4 with the fixation function and the signal contacts 2, 3. The power source contacts 4 with the fixation function and the simple power source contacts 5 are connected in parallel.

- Thickness of the power source contacts 4 with the fixation function: 0.12 mm
- Length of the power source current path of the power source contacts 4 with the fixation function: 2.10 mm
- Resistance value of the power source contacts 4 with the fixation function: 16.0 mΩ
- Thickness of the simple power source contacts 5: 0.12 mm
- Length of the power source current path of the simple power source contacts 5: 2.10 mm
- Resistance value of the simple power source contacts 5: 16.0 mΩ
- Resistance value of the entire connector: 8.0 mΩ

Comparison Example

The configuration of Comparison Example 1 is as follows.

One pair of locking members only for the engagement of the object to be connected is disposed at both ends of the housing. A first power source contact and a second power source contact having a configuration equal to that of the signal contacts of the first and the second embodiment of the present invention are disposed between the pair of the locking members. In Comparison Example 1, a signal contact is used for energizing.

- Thickness of the first power source contacts: 0.08 mm
- Length of the power source current path of the first power source contacts: 2.60 mm
- Resistance value of the first power source contacts: 24.0 mΩ
- Thickness of the second power source contacts: 0.08 mm
- Length of the power source current path of the second power source contacts: 3.45 mm
- Resistance value of the second power source contacts: 30.0 mΩ
- Entire resistance value of the first power source contact and the second power source contact connected in parallel: 13.0 mΩ

The term "length of the power source current path" means here a length from the contact portion at which the power source contact comes into contact with the object to be connected up to the connection portion along the power source contact.

In Embodiment 1, the resistance value of the entire connector is 8.0 mΩ. On the other hand, the resistance value of the connector of Example 1 is 13.0 mΩ. In consideration of the above, the resistance value can be sufficiently suppressed in Comparison Example 1 (e.g. 10 mΩ or less), thus, it is evident that the connector has a high quality.

Furthermore, in Example 1, the one pair of the locking members (having a thickness of 0.08 mm) used in the Comparison Example 1 was not used. Since the power source contact 4 with the fixation function comprises also a function as the locking member, it is not necessary to independently provide the locking member. Thus, in Example 1, the thickness of the outer and the simple power source contact could be increased only by the plate thickness of the locking member, and the resistance value Ω could be sufficiently decreased.

Since the power source contact 4 with the fixation function that also serves as the locking member is used, it is not necessary to increase a number of the core wire of the connector even if the thickness of the power source contact 4 with the fixation function and the simple power source contact 5 increases. By omitting the locking member, the mutual pitch between the contacts in the housing 1 can be reduced. Thus, the downsizing of the connector can be achieved.

INDUSTRIAL APPLICABILITY

As of the connector of the present invention by providing a power source contact which has a power source connection function by which a large current is allowed to flow while suppressing the resistance value of the entire connector, as well as a fixation function by which the object to be connected is capable of being provisionally fixed in the housing, the connector could be downsized.

What is claimed is:

1. A connector detachably fitted to an object to be connected, comprising:

a housing, having a fitting opening for insertion and extraction of the object to be connected, a desired number of signal contacts (SC), being retained in the housing in parallel with each other, a pressure member, having a portion with a shape capable of pressing the signal contact (SC), and at least one pair of power source contacts (PC), which is retained in the housing at both end sides of the desired number of the signal contacts (SC) along the signal contacts (SC), has a thickness dimension larger than that of the signal contact (SC), is configured to be pressed by the pressure member together with the signal contact (SC), and has a power source connection function, wherein the at least one pair of the power source contacts (PC) comprises a power source contact (LPC) with a fixation function which has not only the power source connection function but also a function by which the object to be connected is temporally fixed at a correct insertion position with respect to the signal contact (SC) as well as the object to be connected is clamped and fixed in a state being pressed by the pressure member.

2. The connector of claim 1, wherein the at least one pair of the power source contacts (PC) further comprise at least one pair of simple power source contacts (NPC) located between the one pair of the power source contacts (LPC) with the fixation function and the desired number of the signal contacts (SC), or respectively outside the power source contact (LPC) with the fixation function.

3. The connector of claim 1, wherein the power source contact (LPC) with the fixation function comprises:

a contact portion (LPC1), which comes into contact with one of the both surfaces of the object to be connected;

an engagement portion (LPC2), which has a shape protruding toward a portion to be engaged at a position corresponding to the portion to be engaged formed at the inserted object to be connected;

a coupling portion (LPC5), which couples the contact portion (LPC1) and the engagement portion (LPC2);

a pressure receiving portion (LPC3), which extends from one end side of the coupling portion (LPC5) to a side opposite to the fitting opening and is pressed by the pressure member; and a connection portion (LPC4), which extends from the other end side of the coupling portion (LPC5) to a side opposite to the fitting opening and is to be connected to a substrate.

4. The connector of claim 3, wherein a portion of the power source contact (LPC) with the fixation function located between the connection portion (LPC4) and the coupling portion (LPC5) has a width dimension equal to or larger than the thickness dimension.

5. The connector of claim 1, wherein the power source contact (LPC) with the fixation function comprises:

a contact portion (LPC1), which comes into contact with one of the both surfaces of the object to be connected;

an engagement portion (LPC2), which has a shape protruding toward a portion to be engaged at a position corresponding to a portion to be engaged formed at the inserted object to be connected;

a coupling portion (LPC5), which couples the contact portion (LPC1) and the engagement portion (LPC2);

a pressure receiving portion (LPC3), which extends from one end side of the coupling portion (LPC5) to a side opposite to the fitting opening and is pressed by the pressure member; and a connection portion (LPC4), which extends from the other end side of the coupling portion (LPC5) to a side of the fitting opening and is to be connected to a substrate.

6. The connector of claim 3, wherein the power source contact (LPC) with the fixation function further comprises a facing contact portion (LPC6) between the engagement portion (LPC2) and the coupling portion (LPC5), to be in contact with a surface opposed to a surface of the object to be connected, with which the contact portion (LPC1) comes into contact.

7. The connector of claim 3, wherein the pressure member rotates in a range of rotation from a pressure release completion position at which the object to be connected is capable of being inserted into and extracted from the housing, without pressing the signal contact (SC) and the power source contact (PC), to a pressure completion position at which the signal contact (SC) and the power source contact (PC) are pressed and a pressure contact state of the signal contact (SC) and the power source contact (PC) with respect to the object to be connected located at the correct insertion position is stably kept so that the object to be connected is fixed at the correct insertion position.

8. The connector of claim 7, wherein at least a portion of the pressure receiving portion (LPC3) of the power source contact (LPC) with the fixation function which the pressure member presses and comes into contact with is formed flat.

9. The connector of claim 7, wherein the power source contact (LPC) with the fixation function further comprises a swelling prevention means at a tip end portion of the pressure receiving portion (LPC3) which prevents the pressure member from swelling and moving into a direction opposite to the fitting opening of the housing resulting from repulsion to a pressure of the pressure member.

10. The connector of claim 2, wherein the simple power source contact (NPC) comprises:

a contact portion (NPC1), which comes into contact with one of the both surfaces of the object to be connected located at the correct insertion position;

a pressure receiving portion (NPC2), which is pressed by the pressure member;

a connection portion (NPC3), which is to be connected to a substrate; and a coupling portion (NPC4), which couples the contact portion (NPC1), the pressure receiving portion (NPC2) and the connection portion (NPC3);

wherein the contact portion (NPC1) and the pressure receiving portion (NPC2) extend from one end side of the coupling portion (NPC4) to mutually opposite sides, and the connection portion (NPC3) extends from the other end side of the coupling portion (NPC4) to the side opposite to the fitting opening.

11. The connector of claim 10, wherein a portion of the simple power source contact (NPC) located between the connection portion (NPC3) and the coupling portion (NPC4) has a width dimension equal to or larger than the thickness dimension.

12. The connector of claim 2, wherein the simple power source contact (NPC) comprises:

a contact portion (NPC1), which comes into contact with the object to be connected located at the correct insertion position;

a pressure receiving portion (NPC2), which is pressed by the pressure member;

a connection portion (NPC3), which is to be connected to a substrate; and a coupling portion (NPC4), which couples the contact portion (NPC1), the pressure receiving portion (NPC2) and the connection portion (NPC3);

wherein the contact portion (NPC1) and the pressure receiving portion (NPC2) extend from one end side of the coupling portion (NPC4) to mutually opposite sides, and the connection portion (NPC3) extends from the other end side of the coupling portion (NPC4) toward a side of the fitting opening.

13. The connector of claim 10, wherein the simple power source contact (NPC) comprises a facing contact portion (NPC5) to come into contact with a surface opposed to a surface of the object to be connected, with which the contact portion (NPC1) comes into contact.

14. The connector of claim 10, wherein at least a portion of the pressure receiving portion (NPC2) of the simple power source contact (NPC) which the pressure member presses and comes into contact with is formed to be flat.

15. The connector of claim 10, wherein the simple power source contact (NPC) comprises a swelling prevention means at a tip end portion of the pressure receiving portion (NPC2) which prevents the pressure member from swelling and moving into a direction opposite to the fitting opening of the housing resulting from repulsion to a pressure of the pressure member.

16. The connector of claim 1, wherein the housing comprises a plurality of grooves formed at an inner surface facing the direction of height of the housing to individually retain all of the contacts.

* * * * *